US006490971B2

(12) United States Patent
Rosenberg et al.

(10) Patent No.: US 6,490,971 B2
(45) Date of Patent: Dec. 10, 2002

(54) APPARATUS AND METHOD FOR FRAMING A PRINTING SCREEN

(76) Inventors: Steven S. Rosenberg, 700 Dulfinch Rd., Andover, MA (US) 01880; Steven J. Lambert, 865 N. River Rd., Greene, ME (US) 04236; Dana A. Papworth, 406 Poland Ctr. Rd., Poland, ME (US) 04274

( * ) Notice: Subject to any disclaimer, the term of this patent is extended or adjusted under 35 U.S.C. 154(b) by 91 days.

(21) Appl. No.: 09/784,119

(22) Filed: Feb. 16, 2001

(65) Prior Publication Data

US 2002/0112622 A1 Aug. 22, 2002

(51) Int. Cl.[7] ..... B41L 13/02
(52) U.S. Cl. ..... 101/129; 101/127.1
(58) Field of Search ..... 101/127, 127.1, 101/126, 129; 118/301

(56) References Cited

U.S. PATENT DOCUMENTS 4,905,592 A * 3/1990 Sorel ..... 101/123
4,981,076 A 1/1991 Cunill
5,220,867 A 6/1993 Carpenter
5,265,534 A 11/1993 Hamu
5,279,221 A 1/1994 Miller et al.
5,463,948 A 11/1995 Newman
5,598,776 A 2/1997 Casl
5,743,182 A 4/1998 Kobayashi et al.
5,802,971 A 9/1998 Hamu

FOREIGN PATENT DOCUMENTS

EP 0 511 605 A1 11/1992
EP 0 727 309 A1 8/1996
GB 921813 3/1963

* cited by examiner

*Primary Examiner*—Andrew H. Hirshfeld
*Assistant Examiner*—Kevin Williams
(74) *Attorney, Agent, or Firm*—Richard C. Litman

(57) ABSTRACT

An apparatus and method for framing a printing screen comprising a clamping element having a shape to conform to the mug frame with four threaded posts for attaching to a steel baseplate by fasteners. The screen is attached to the mug frame by adhesive and trimmed for screen printing.

7 Claims, 3 Drawing Sheets

APPARATUS AND METHOD FOR FRAMING A PRINTING SCREEN

BACKGROUND OF THE INVENTION

1. Field of the Invention

The present invention relates generally to screen printing and, more specifically, to a new apparatus and method for framing a printing screen.

2. Description of the Related Art

The related art of interest describes various apparatus and methods for framing a printing screen, but none discloses the present invention. There is a need for an apparatus and method that is safe, at least four times faster, and requires less skilled workers to obtain framed silk screens having a highly consistent tension.

The related art will be discussed in the order of perceived relevance to the present invention.

U.S. Pat. No. 5,463,948 issued on Nov. 7, 1995, to Donald E. Newman describes a mug imprinting roller frame comprising a curved item printing frame with a plurality of tensioning devices coupled together by corner members which support the tensioning devices for rotation about their longitudinal axes. The apparatus is distinguishable for its pair of rotating tensioning devices.

U.S. Pat. No. 5,598,776 issued on Feb. 4, 1997, to Slobodan Casl describes a screen printing apparatus comprising a base frame in the shape of a convex-rectangle, four tensioning rods attached to a printing screen fabric, four pairs of collars, and four pairs of bearing blocks. The apparatus is distinguishable for the rotating tensioning rods with bearing blocks and collars.

U.S. Pat. No. 5,743,182 issued on Apr. 28, 1998, to Akio Kobayashi et al. describes a stencil printing apparatus comprising a pressure chamber having opposite walls built up via a frame-like packing. The apparatus is distinguishable for requiring a pressure chamber.

U.S. Pat. No. 5,279,221 issued on Jan. 18, 1994, to Michael J. Miller et al. describes a screen printing apparatus comprising a uniformly-prestressed resilient backing screen attached to a frame attached to a metallic wire mesh stencil screen. The apparatus is distinguishable for the double frame structure requiring peripheral fasteners.

U.S. Pat. No. 5,220,867 issued on Jun. 22, 1993, to Robert C. Carpenter describes an adjustable tensioned silk screen frame of the floating bar type comprising a retensionable stretch and glue screen printing frame using screen attachment members of specific cross-section to maximize the available printing surface provided by the screen frame. The frame is distinguishable for utilizing a double-frame structure for obtaining tension.

U.S. Pat. No. 5,265,534 issued on Nov. 30, 1993, to Kaino J. Hamu describes a screen roller printing frame having screen tensioning rollers which are rotatable to stretch a printing screen edgewise across the frame, and are mounted on the frame by improved roller mounting assemblies that secure the rollers to roller mounting members at the roller ends. The printing frame is distinguishable for its requirement for tensioning rollers.

U.S. Pat. No. 5,802,971 issued on Sep. 8, 1998, to Alan J. Hamu et al. describes a screen printing frame assembly with screen anchors to mount a printing screen. The four cylindrical frame members are anchored at their joints by right-angled brackets and fasteners. The frame assembly is distinguishable for its cylindrical frame members and anchoring brackets.

U.S. Pat. No. 4,981,076 issued on Jan. 1, 1991, to Angel S. Cunill describes a centralizing device for preparing a silk screen for a silk screen printing machine comprising three rectangular frames for insulating the silk screen between two frames and embedded in the screen holder frame of the silk screen printing machine. The device is distinguishable for requiring three frames.

Gt. Britain Patent Application No. 921,813 published on Mar. 27, 1963, for Jeffrey Cotterel describes an apparatus and method for an improvement in silk screen printing comprising a rectangular frame having rotatable members in each frame limb for attaching and stretching the silk screen. The apparatus is distinguishable for its requirement for stretching mechanisms in each frame limb.

E.P.O. Patent Application No. 0 511 605 A1 published on Nov. 4, 1992, for Friedrich Beutelrock describes an apparatus and method for printing an object with a curved or faceted surface comprising the use of an electrostatic field to imprint objects with dyes. The apparatus is distinguishable for requiring electrostatic means.

E.P.O. Patent Application No. 0 727 309 A1 published on Aug. 21, 1996, for Giovanni Bormioli describes a machine for the multi-color silk screen printing of containers with curved surfaces. The machine is distinguishable for its automated printing machinery.

None of the above inventions and patents, taken either singularly or in combination, is seen to describe the instant invention as claimed. Thus, a screen printing frame solving the aforementioned problems is desired.

SUMMARY OF THE INVENTION

The present invention is directed to an apparatus and method for framing a printing screen comprising a clamping element having a shape to conform to the mug frame with four threaded posts for attaching to a steel baseplate by fasteners. The screen is attached to the mug frame by adhesive and trimmed for screen printing. It has been determined that less skill and one-fourth the typical mounting time is required for implementing the screen preparation process with the inventive apparatus.

Accordingly, it is a principal object of the invention to provide an apparatus for framing a printing screen.

It is another object of the invention to provide an apparatus for framing a printing screen comprising a clamping element having a shape to conform to the mug frame with four threaded posts for attaching to a steel baseplate by fasteners.

It is a further object of the invention to provide an apparatus for framing a printing screen comprising a clamping element having a shape to conform to the mug frame.

Still another object of the invention is to provide a safer apparatus for framing a printing screen requiring less skilled personnel and one-fourth the time required for implementing the silk screen preparation process with the inventive apparatus.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
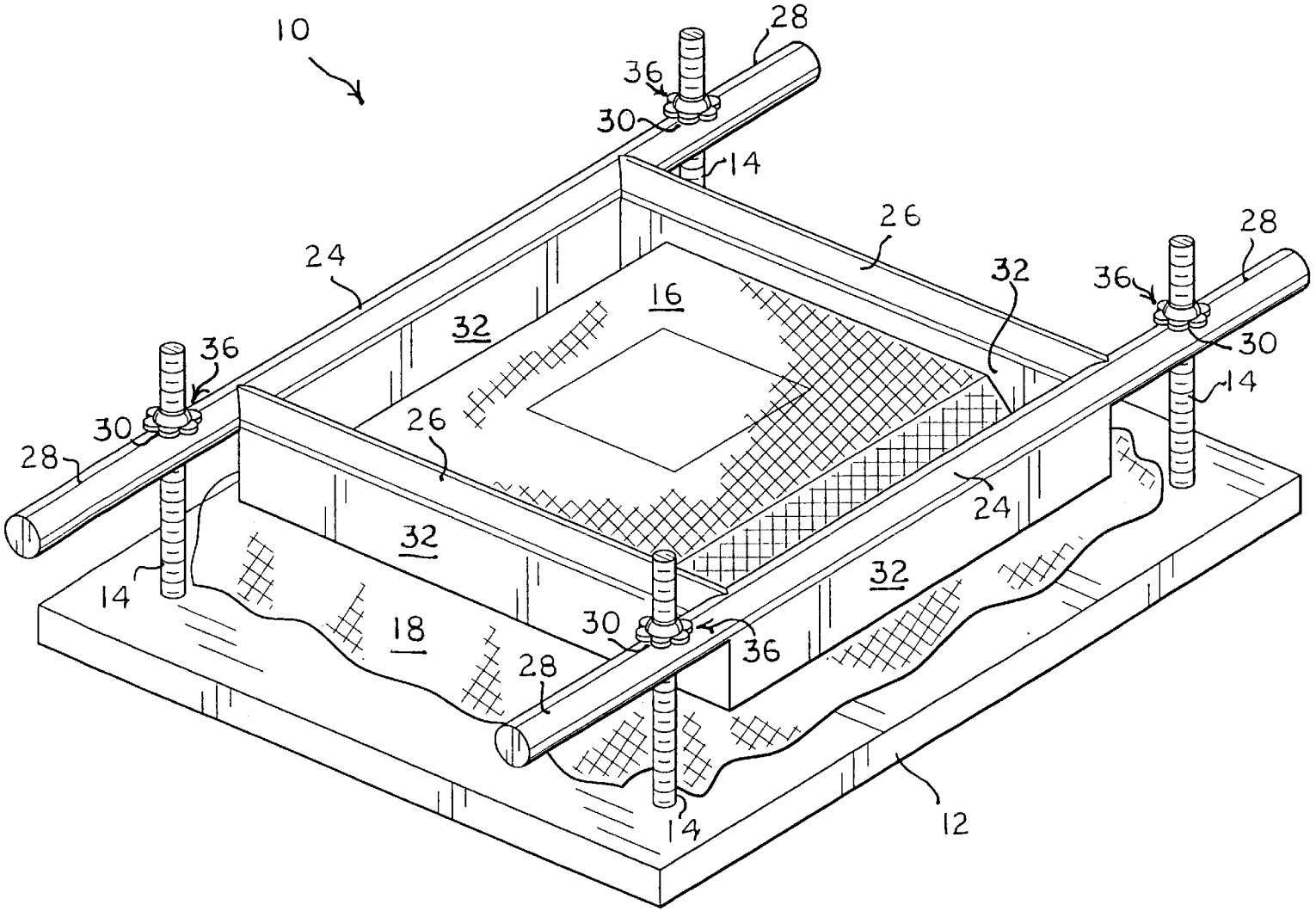
FIG. 1 is an environmental, perspective view of a printing screen framer apparatus according to the present invention.

The present invention is directed to a printing screen frame production apparatus 10 depicted in FIG. 1 proceeding to subsequent processing steps illustrated in FIGS. 2 through 5. A rectangular steel base plate 12 has four threaded steel posts 14 located proximate its corners. A conventional rectangular steel mug frame 16 is centrally positioned on the base plate 12. The mug frame 16 can be made integral with the base plate 12 or attached by fasteners. The conventional mug frame 16 can be rectangular or square in shape having a planar top surface and four inclined sides. The base plate 12 is fixed on a planar substrate such as a table top (not shown) equipped with tensioning apparatus explained below.

Figure 2:
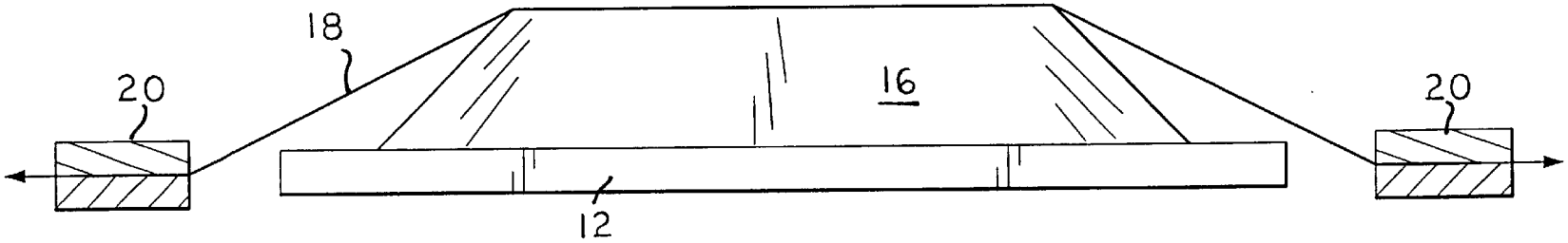
FIG. 2 is a schematic side view of a screen being given an initial tension over the mug frame.

As depicted in FIG. 2, a rectangular piece of a conventional fabric screen 18 is placed over the mug frame 16 and stretched uniformly in four directions (only two directions shown) by the jaws 20 of a conventional stretcher.

Figure 3:
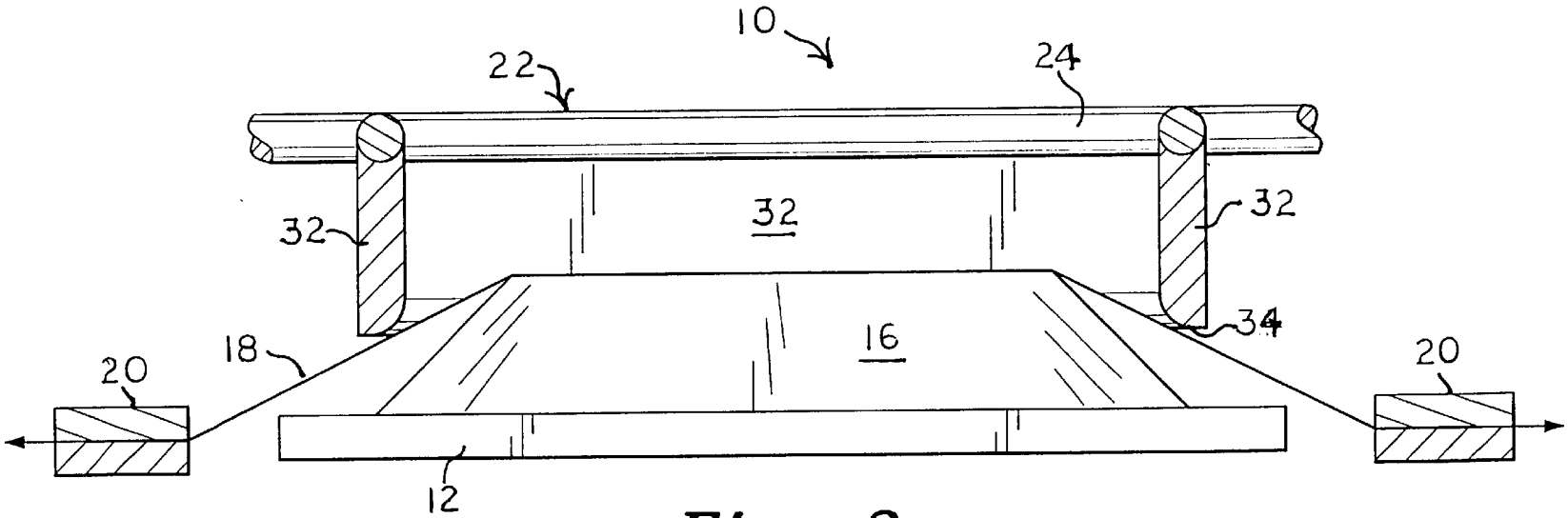
FIG. 3 is a schematic side view of a screen with the clamp positioned over the mug frame.

Then as shown in FIGS. 1 and 3, the innovative clamp 22 is centered over the stretched screen 18. The clamp 22 consists of two parallel arms 24 joined by two parallel crossbars 26. The end elements 28 of the arms 24 have apertures 30 proximate the ends for positioning on the four threaded posts 14. Four vertical walls 32 having curved tips 34 forming a quarter-circle in cross-section extend from the arms 24 and crossbars 26. The clamp 22 is held in place by positioning the star nuts or the like fasteners 36 loosely on the posts 14.

Figure 4:
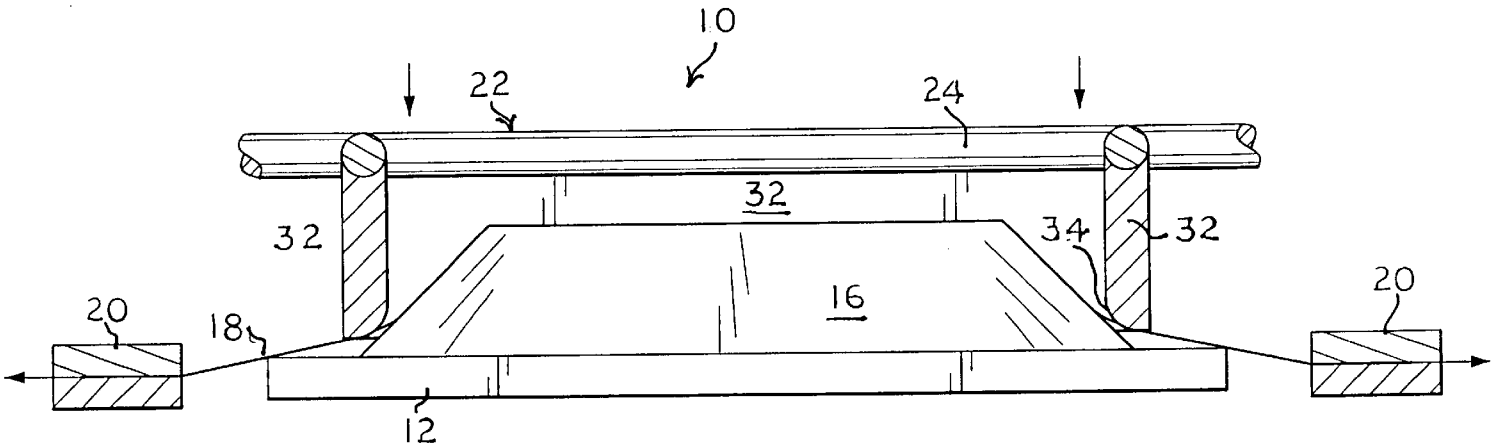
FIG. 4 is a schematic side view of a screen with the clamp applying a target tension and gluing the screen around the mug frame.

Referring to FIG. 4, the initial downward pressure of the clamp 22 is initiated on the screen 18 by evenly tightening down the fasteners 36 on the posts 14. Glue (not shown) is applied on the exposed sides of the mug frame 16 and the screen 18, and dried to secure the screen on the mug frame. The exposed excess edges of the screen 18 are now trimmed.

Figure 5:
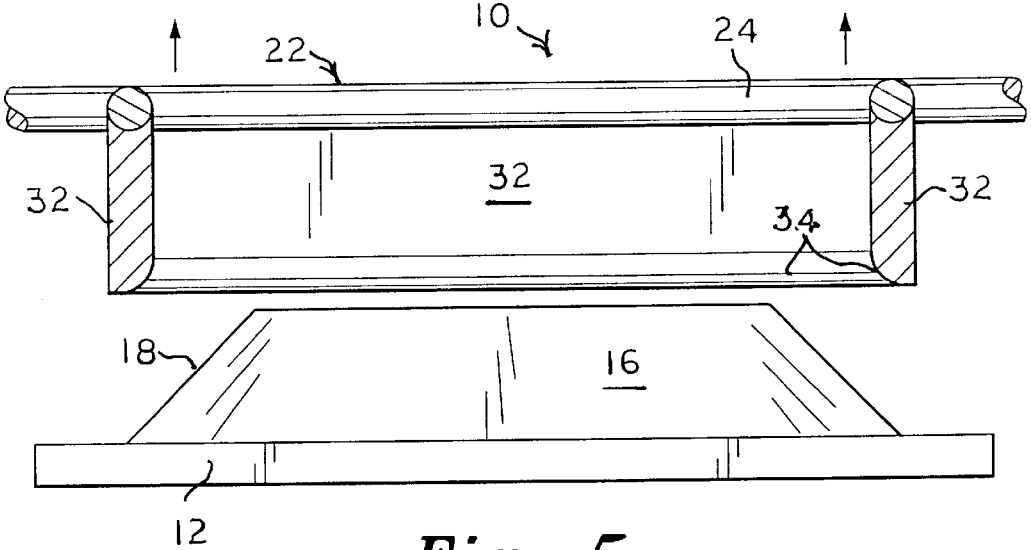
FIG. 5 is a schematic side view of a screen with the clamp removed from the mug frame and the screen trimmed.

The clamp 22 is lifted as shown in FIG. 5 from the trimmed screen 18 and the mug frame 16 by removing the fasteners 36 from the posts 14 to provide a trimmed screen 18.

Thus, the present invention provides a safer apparatus for framing a printing screen requiring less skilled personnel and one-fourth the time required for implementing the printing screen framing process with the inventive apparatus.

It is to be understood that the present invention is not limited to the embodiment described above, but encompasses any and all embodiments within the scope of the following claims.

What is claimed is:

1. An apparatus for framing a printing screen comprising:

a rectangular planar base plate having four corners and four upright threaded posts with fasteners, wherein each post is positioned in each corner;

a rectangular mug frame having four inclined sides centered on the base plate;

a clamp element consisting of two parallel arms joined by two parallel crossbars to form four end elements extending from the two parallel arms, wherein each end element has an aperture to define a larger rectangle;

four walls depending vertically from the arms and crossbars to define a rectangular frame; and four tensioning jaws spaced on four sides of the mug frame;

whereby a planar printing screen can be tensioned, glued to the mug frame and trimmed to form a framed printing screen.

2. The apparatus according to claim 1, wherein the walls of the clamp element abut the inclined sides of the mug frame proximate the base plate.

3. The apparatus according to claim 1, wherein the walls of the clamp element have curved tips which curve away from the mug frame sides.

4. The apparatus according to claim 3, wherein the curved tips form a quarter-circle in cross-section.

5. A method for framing a printing screen comprising:

providing a rectangular planar base plate having four corners and four upright threaded posts with fasteners, wherein each post is positioned in each corner;

providing a rectangular mug frame having four inclined sides centered on the base plate;

spreading a rectangular piece of printing screen material over the mug frame;

attaching a tensioning jaw to each side of the printing screen material and stretching the silk screen material evenly taut over the mug frame;

positioning a clamp element consisting of two parallel arms joined by two parallel crossbars which form four end elements having apertures onto each post;

lowering the clamp element over the printing screen material to evenly stretch the screen material by attaching fasteners to the posts and pressing the clamp element down on the screen material and the mug frame;

applying glue to the stretched printing screen material around the inclined sides of the mug frame; and drying the glue and trimming excess printing screen material to form a printing screen.

6. The method according to claim 5, wherein the walls of the frame are lowered to abut the inclined sides of the mug frame proximate the base plate.

7. The method according to claim 5, wherein the walls of the clamp element have curved tips which curve away from the mug frame sides.

* * * * *